US007008358B2

(12) United States Patent
Goukassian

(10) Patent No.: US 7,008,358 B2
(45) Date of Patent: Mar. 7, 2006

(54) EXERCISING APPARATUS

(76) Inventor: Katja Goukassian, Fristadsgatan 2A, 3van, 633 45 Eskilstuna (SE)

( * ) Notice: Subject to any disclaimer, the term of this patent is extended or adjusted under 35 U.S.C. 154(b) by 0 days.

(21) Appl. No.: 10/381,578

(22) PCT Filed: Nov. 12, 2001

(86) PCT No.: PCT/SE01/02497

§ 371 (c)(1),
(2), (4) Date: Mar. 25, 2003

(87) PCT Pub. No.: WO02/38230

PCT Pub. Date: May 16, 2002

(65) Prior Publication Data

US 2003/0181298 A1 Sep. 25, 2003

(30) Foreign Application Priority Data

Nov. 13, 2000 (SE) ..... 0004143

(51) Int. Cl.
*A63B 26/00* (2006.01)

(52) U.S. Cl. ..... 482/142; 482/95; 482/96

(58) Field of Classification Search ..... 482/142, 482/95–96, 148

See application file for complete search history.

(56) References Cited

U.S. PATENT DOCUMENTS 5,011,139 A * 4/1991 Towley, III ..... 482/38
5,496,241 A * 3/1996 Sellers ..... 482/51
5,554,083 A * 9/1996 Chen ..... 482/95

* cited by examiner

*Primary Examiner*—Gregory L. Huson
*Assistant Examiner*—L. Amerson
(74) *Attorney, Agent, or Firm*—Rolf Fasth; Fasth Law Offices

(57) ABSTRACT

The exercising apparatus has a body support against which the torso of a person using the apparatus mainly rests. The apparatus also has first, upper support means (2; 22; 32) for the person's upper extremities and second, lower support means (3; 23; 33) for the person's lower extremities. The apparatus has drive means (9; 39) for moving the upper and lower support means so that the person's extremities, starting from a rest position (A) are imparted a movement outwardly from the sides of the torso and upwardly towards the person's head, along parts of circular paths, to a turning point (B) and thereafter back to the rest position (A).

7 Claims, 4 Drawing Sheets

EXERCISING APPARATUS

PRIOR APPLICATIONS

Figure 1:
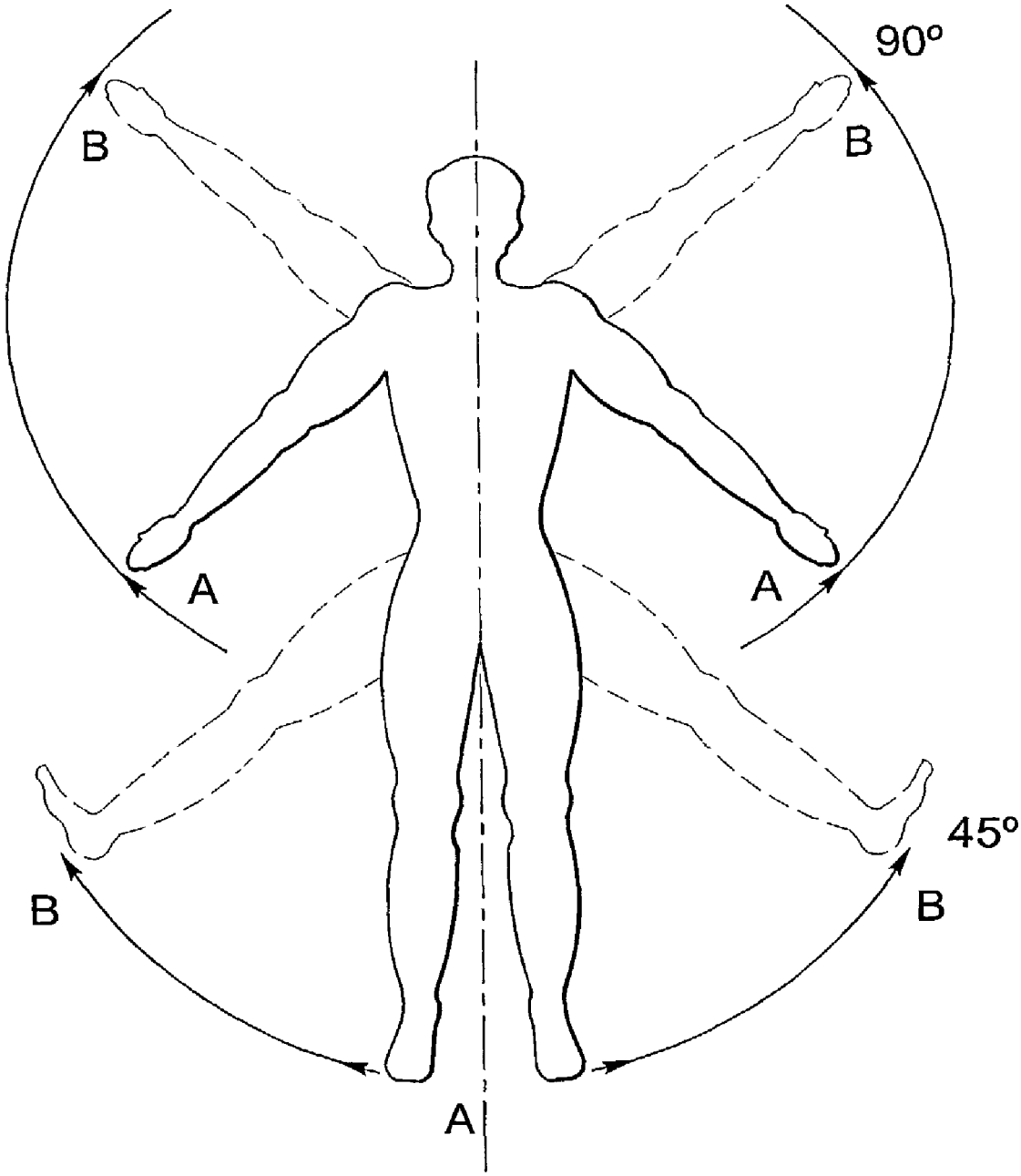

This is a US national phase patent application that claims priority from PCT/SE01/02497, filed 12 Nov. 2001, that claims priority from Swedish Patent Application No. 0004143-4, filed 13 Nov. 2000.

The present invention relates to an exercising apparatus in which the arms and legs of a person using the apparatus are imparted a movement as described in the preamble to claim 1.

It is generally known that passive exercising can be used to build up the muscular system. Both perfectly healthy people, e.g. athletes, dancers, etc., and people who for various reasons have reduced muscular strength and need rehabilitation, may desire to build up their muscles. This may apply, for instance, to people who for various reasons have suffered paralysis of the arms and legs and are therefore unable to move their arms and/or legs without aids. It may also apply to people who, due to heart trouble, have difficulty in moving their arms and legs in a manner beneficial to the muscles and therefore require assistance in maintaining the muscular system. Maintaining the muscular system is of the utmost importance so that in due course, when the situation has improved, e.g. the paralysis has partially passed, the person will be able to use his/her arms and legs again. In many cases it is even a condition that the muscles in arms and legs have not become too weak, if rehabilitation is to be possible at all.

In many cases it is also desirable to increase a person's suppleness and ability to move. This may apply both to perfectly healthy people as well as to people in the process of being rehabilitated. When only the strength of a muscle is exercised it will be shortened. This gives the muscle a shorter working path but in practice it also results in a reduced ability to correctly utilise the increased strength resources. Performing stretching exercises is then a method of quickly increasing the length of a muscle group and thus the amount of movement in the joint.

Various types of apparatuses are already known which attempt to solve the above-mentioned problems in various ways, such as described in U.S. Pat. No. 3,895,623 and DE-A-40 39 843. These known apparatuses are directed primarily to exercising the legs in walking-like movements, with corresponding movement for the arms. The person using the apparatus in then lying down. These apparatuses offer no opportunity for stretching. Neither do they offer any exercising of the muscles and muscle parts used in sideways movements.

The object of the present invention is to provide a solution to the above-mentioned problems by proposing an improved exercising apparatus, in particular for passive exercising of the arm and leg muscles, both to increase the muscles and to increase mobility by means of stretching.

The above-mentioned object of the invention is achieved by means of an exercising apparatus as defined in the characterizing part of claim 1.

The present invention thus relates to an exercising apparatus comprising a body support against which the torso of a person using the apparatus mainly rests, and also comprising first, upper support means for the person's upper extremities and second, lower support means for the person's lower extremities. It also comprises a drive means for moving said upper and lower support means so that the person's upper and lower extremities, respectively, starting from a rest position, are imparted a movement outwards from the sides of the torso and upwards towards the person's head or a point thereabove, along parts of a circular path, to a turning point and thereafter back to the rest position. With the aid of this exercising apparatus, therefore, arms and legs are caused to perform a pendular movement which has a strengthening effect on the musculature in the limbs. In addition, stretching of the muscles is obtained throughout the movement, particularly at the turning point which can be set depending on the potential of the individual and where maximum stretch is obtained.

The apparatus operates in accordance with the PNF method, also known as the contraction-relaxation-stretch method. With the aid of the exercising apparatus according to the present invention the following muscles can be exercised by means of the lateral movements performed:

The seat muscular system: This contributes to stabilising the hip joints when only one foot is in contact with the ground, which is the case e.g. when running. These muscles are subjected to particularly great strain when running uphill and downhill.

The groin muscular system: This contributes to inward swing of the leg. All types of activity involving swinging of the leg cause considerable strain on this muscle.

The hip joint: This musculature is subjected to considerable strain during running, jumping, javelin-throwing, sit-ups, etc. The object here is to achieve as great a distance as possible between origin of the movement and the muscular attachment, through stretching.

The inside of the hip: Increased mobility gives increased stride and less risk of groin injury.

The large chest muscle and broad back muscle: The movement of the arms is used to relieve or put weight on the body in a number of different activities.

The exercising apparatus in accordance with the invention has the advantage of increasing the efficiency and facilitating the exercise that constitutes the basis for almost all athletes, dancers, etc. and for physiotherapy.

It also contributes to reducing the risk of injuries occurring, particularly through longer running step.

It should be emphasised that it is a great advantage to be able to exercise by performing lateral movements since existing apparatuses do not offer any such possibility.

In accordance with the present invention the upper support means for the upper extremities comprises handles which can be gripped by the user's hands. In corresponding manner the lower support means preferably comprises foot rests for the person's lower extremities. The positions of these handles and foot rests are preferably adjustable to suit the length of the user's extremities.

According to a preferred embodiment the drive means of the apparatus comprises a drive unit and a turning mechanism connecting said drive unit to said upper and lower support means and transmitting a turning movement to them.

It should also be mentioned that the apparatus can be set, or parts may be disconnected, so that not all extremities must be exercised simultaneously. It is thus possible to exercise only one leg, for example, if so desired.

The present invention is primarily useful for passive exercising of the musculature in arms and legs but also has the advantage that it can be used for various degrees of active training depending on how the drive means controlling the movements are set. The apparatus also provides a certain amount of condition exercising, i.e. the cardiac musculature also works harder to a certain extent when a person exercises with the aid of the apparatus.

Additional features and advantages are revealed in the subordinate claims.

Figure 2:
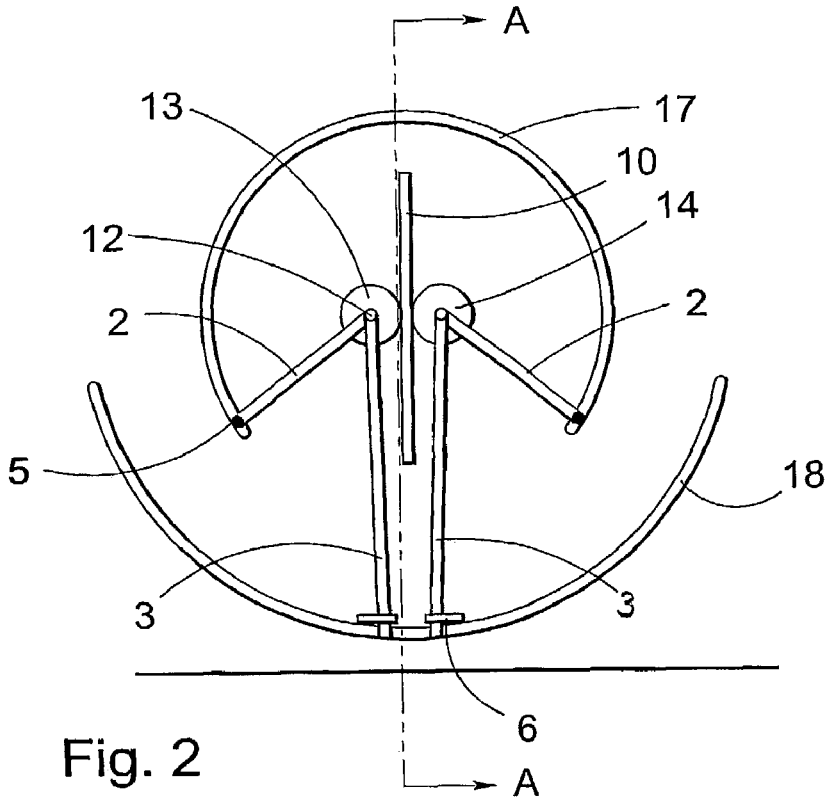
Figure 3:
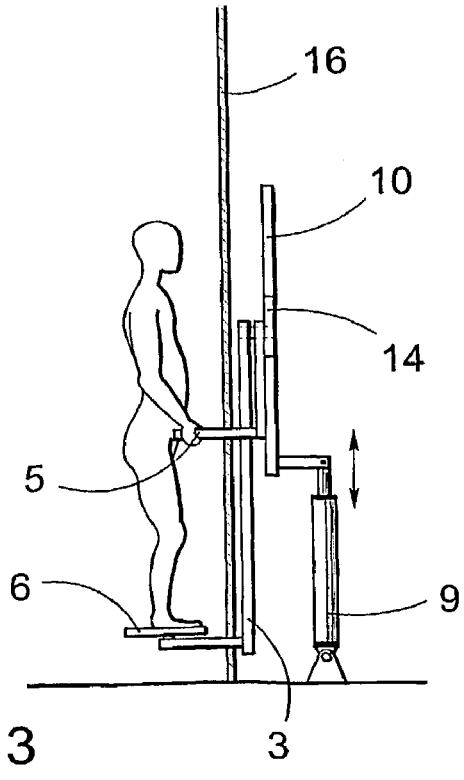
Figure 4:
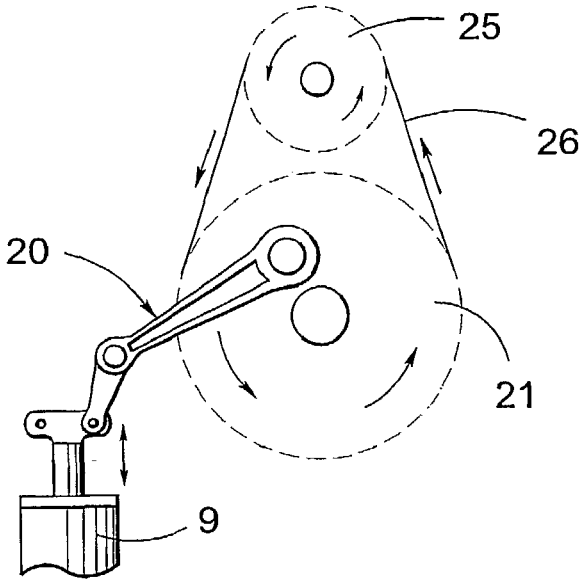
Figure 5:
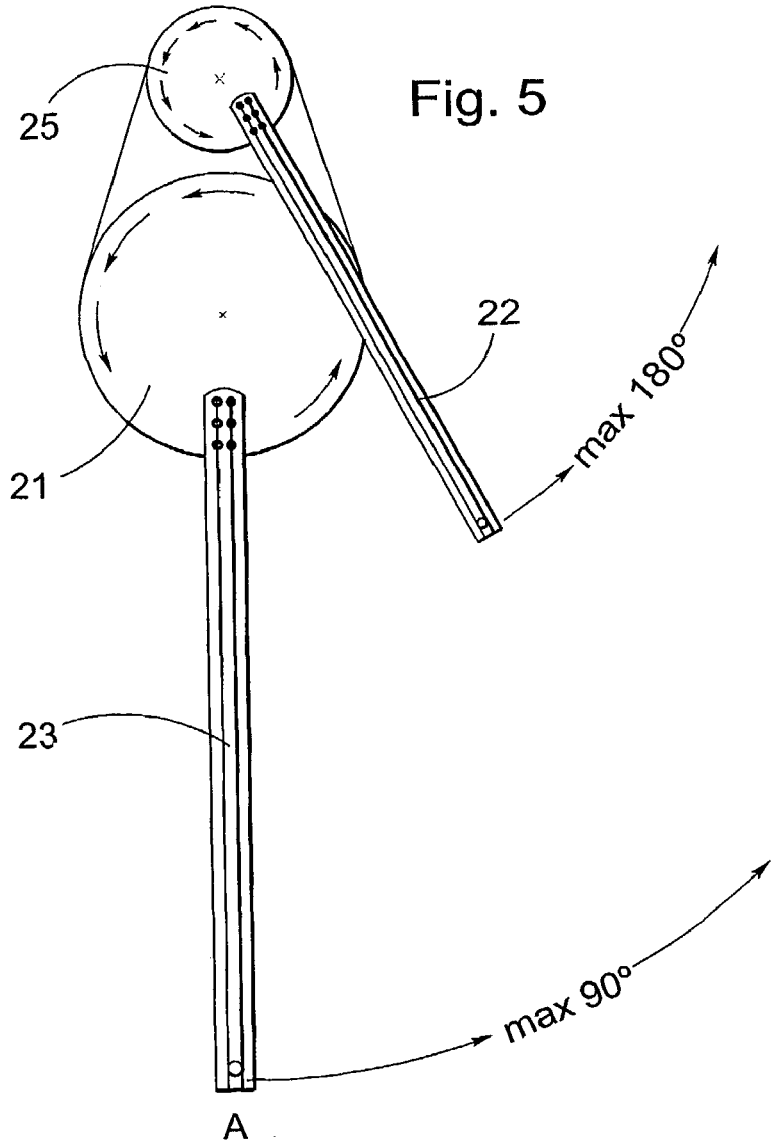
Figure 6:
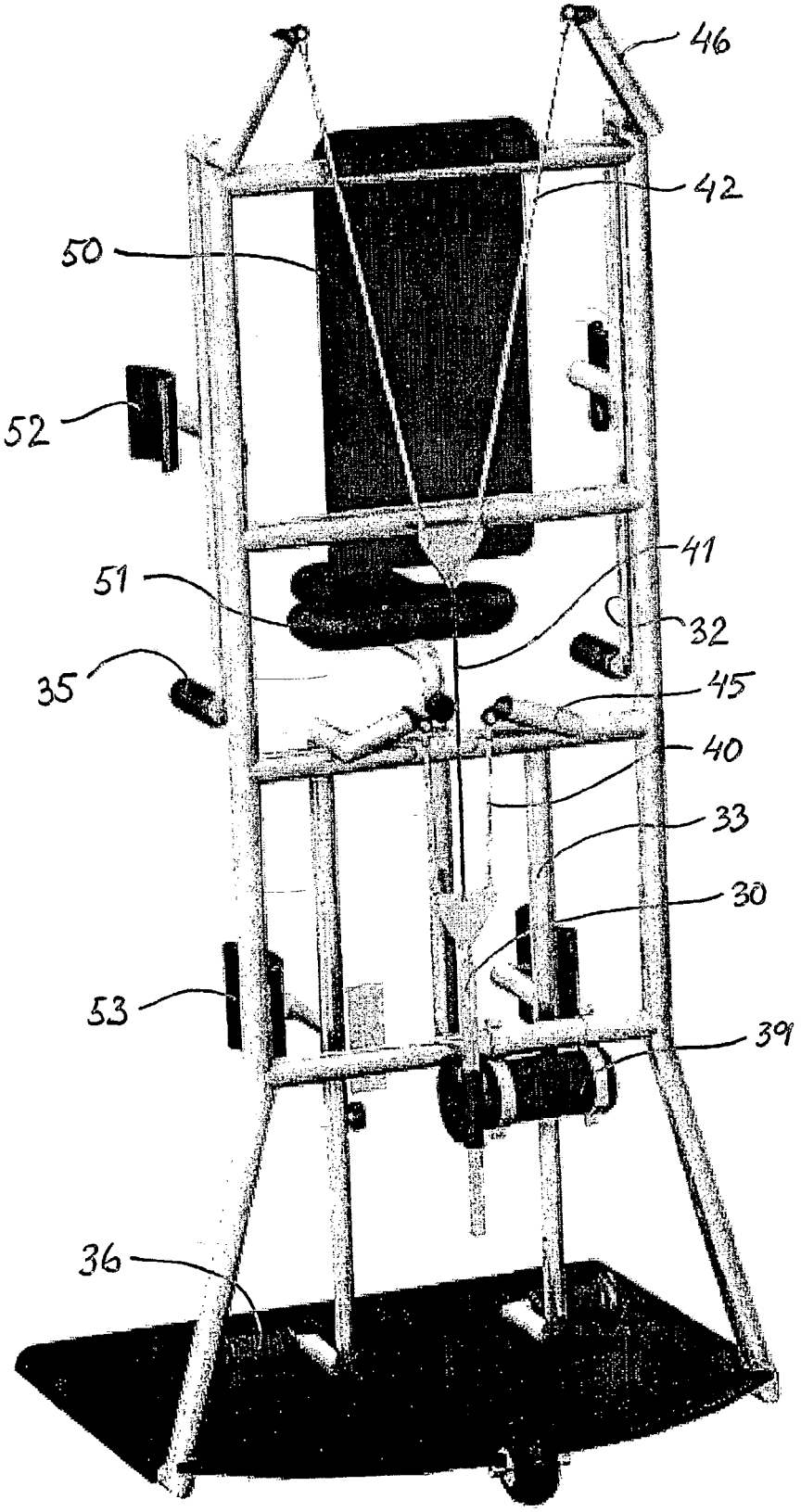

The invention will now be described with reference to the embodiments illustrated by way of example, with reference to the accompanying drawings in which:

FIG. 1 illustrates an example of a set of movements a person using the apparatus in accordance with the invention may suitably perform, FIG. 2 illustrates schematically a first embodiment of an apparatus in accordance with the present invention, seen from the front, FIG. 3 illustrates schematically the apparatus in FIG. 2, seen from the side along the line A—A, FIG. 4 illustrates schematically a detail in a second embodiment of an apparatus in accordance with the present invention, FIG. 5 illustrates schematically another detail of an apparatus in accordance with a second embodiment of the invention, and FIG. 6 illustrates schematically a third embodiment of an apparatus in accordance with the present invention.

The pattern of movement illustrated in FIG. 1 shows in unbroken lines a person standing in a rest position A with both legs substantially together and straight below the torso in a straight line therewith. The arms are extended slightly to the sides. With the aid of the apparatus in accordance with the invention the arms and legs will be caused to perform a movement, in the form of a pendular movement, from said rest position A to said turning point B, indicated by broken lines in FIG. 1, and from this turning point the arms and legs are then returned to the rest position A. In the example illustrated the turning point is approximately 45° from the starting position of the legs, and approximately 90° from the starting position of the arms. Both arms and legs have performed a pendular movement following parts of a circular path. The stroke of the angular movement can naturally be varied as desired. The movement of the arms may also be started from a rest position in which the arms are substantially parallel with the body, or any other position. Similarly the movement of the legs may be commenced from a rest position in which the legs are somewhat further apart than is shown in FIG. 1, if desired.

FIGS. 2 and 3 illustrate schematically a first embodiment of an exercising apparatus in accordance with the invention. The apparatus comprises first, upper support means 2 for the upper extremities of the person who is exercising, i.e. the arms and hands, and second, lower support means 3 for the person's lower extremities, i.e. legs and feet. Handles 5 are arranged furthest out on the upper support means and some type of foot rests 6 are arranged furthest out on the lower support means. The apparatus comprises a drive means with drive unit 9 which, in the example illustrated, consists of a pneumatic or hydraulic power cylinder. This drive unit is connected to a rack 10 which is vertically movable, upwards and downwards with the aid of this cylinder. Two toothed wheels 13, 14 are arranged one on each side of and in engagement with the rack 10. These toothed wheels are rotatable in opposite directions with the aid of the rack when this is moved up or down by the cylinder 9.

As can be seen in FIG. 2 the apparatus consists of two identical, mirror-inverted parts, each comprising an arrangement resembling a swing arm consisting of one of said upper support means and one of said lower support means. The swing-arm arrangement can be turned about a shaft of rotation 12. The upper support means, for the arms, here has a fixed position in relation to the lower support means, for the legs, but this naturally need not be the case.

Each of the toothed wheels 13, 14 is connected to said swing-arm arrangement, e.g. in that the swing-arm arrangement is fixed to the shaft of the corresponding toothed wheel, which consequently constitutes said shaft of rotation. When the rack is moved upwards the toothed wheels are turned and the upper and lower support means then travel sideways in opposite directions along parts of a circular path.

The mechanical parts of the apparatus may possibly be situated behind a wall 16, FIG. 3. This may be due to reasons of safety. The wall is then provided with slots 17, 18 through which the handles and foot rests protrude.

FIG. 4 illustrates schematically a second embodiment of an apparatus in accordance with the invention. Here, too, the drive means comprises a drive unit in the form of a power cylinder 9. This power cylinder is connected to a link mechanism or a crank arm 20 by means of which a first disc 21 is caused to rotate when the cylinder 9 performs a to and fro movement. The first disc 21 in turn drives a second disc 25 with the aid of a cogged belt 26 or some similar arrangement. Naturally it is perfectly possible instead for the link mechanism 20 to drive only one rotating disc in a manner corresponding to that illustrated in the first embodiment. Similarly it is also possible to replace the link mechanism in this second embodiment with a rack and adapt the transmission of movement between the rotating discs/toothed wheels to this.

As can be seen in FIG. 5, the first disc 21 is connected to a support means 23 for the lower extremities and the second disc 25 is connected to a support means 22 for the upper extremities. When the first disc 21 rotates, the second disc 22 will also be rotated and a turning or pendular movement will be imparted to the two support means 23 and 22 along part of a circular path in a manner corresponding to that illustrated in FIG. 1. In the example shown in FIGS. 4 and 5 the two discs have different diameters and different gear ratios are obtained for the arm and leg movements, i.e. the stroke length for the arms and legs will be different. In the case illustrated the stroke length of the arm movement is considerably larger than that of the leg movement.

FIG. 6, finally, illustrates a third embodiment of an apparatus in accordance with the present invention. Here, also, is a turning mechanism comprising a rack 30 driven by a drive unit which in this case is an electric motor 39. The support means for arms 32 and legs 33, respectively, are caused to perform their turning or pendular movement with the aid of a lever arrangement. This lever arrangement comprises cords 40,41,42 connecting the rack 30 to bent parts 45,46 of the support means for arms and legs, respectively. When the rack is moved downwards the support means 32, 33 will be turned outwards and upwards by means of this lever arrangement.

As is clear from the placing of the support means in FIG. 6, the arms will assume a rest or starting position in which they are parallel with the body, along the sides of the body. The starting/rest position for both arms and legs should be adjustable as desired in all embodiments.

In the third embodiment shown in FIG. 6 a support for the user's body is also illustrated, in the form of a back rest 50 and a seat or saddle 51. Side supports 52, 53 are also arranged for arms and legs. The apparatus is thus designed primarily for use by a person standing upright and simultaneously resting his/her upper body against the back rest and his/her pelvis against the saddle. However, it is also feasible to provide the exercising apparatus with equipment enabling the apparatus to the incline so that the user can assume a more or less semi-reclining position if so desired. The various supports shall then be adjusted appropriately. It is also possible to remove the seat if desired.

Buttons and controls for adjusting the speed and stroke of the angular movement of the support means are preferably provided in one of the handles or nearby.

It should also be mentioned that the exercising apparatus may also be provided with equipment enabling the user to pass from purely passive muscular exercise to various degrees of active muscular exercise by regulating the extent to which the drive means contribute to accomplishing the movement of the support means.

The present invention shall not be considered limited to what is stated in the embodiments described above by way of example, but may be varied and modified in many ways, as is understood by one skilled in the art, within the scope of the appended claims.

What is claimed is:

1. Exercising apparatus comprising a body support against which the torso of a person using the apparatus mainly rests, and also comprising first, upper support means for the person's upper extremities and second, lower support means for the person's lower extremities, characterized in that it comprises a drive means for moving said upper and lower support means so that the person's upper and lower extremities, respectively, starting from a rest position (A) are imparted a movement outwards from the sides of the torso and upwards towards the person's head or a point thereabove, along parts of circular paths, to a turning point (B) and thereafter back to the rest position (A), the drive means comprises a drive unit and a turning mechanism connecting said drive unit to said upper and lower support means and transmitting a turning movement to them, the turning mechanism comprises a rack that can be moved by said driving unit, and at least two toothed wheels forming first rotating discs and being arranged one on each side of and in engagement with said rack, thereby being rotatable in opposite directions when said rack is moved.

2. Apparatus as claimed in claim 1, characterized in that the upper support means comprises handles which can be gripped by the hands of the upper extremities.

3. Apparatus as claimed in claim 2, characterized in that the position of the handles is adjustable so that it can be adjusted to allow the people using the apparatus to have substantially straight arms even if the length of their arms varies individually.

4. Apparatus as claimed in claim 1, characterized in that the lower support means comprises foot rests against which the feet of the lower extremities rest.

5. Apparatus as claimed in claim 4, characterized in that the position of the foot rests is adjustable so that it can be adjusted to allow the people using the apparatus to have substantially straight legs even if the length of their legs varies individually.

6. Apparatus as claimed in claim 1, characterized in that each of said toothed wheels is arranged about a shaft that is joined to, and also constitutes a swivel joint for one of said upper and one of said lower support means so that movement of said rack effects said movement of the upper and lower support means that imparts the part-circular movements to the upper and lower extremities.

7. Apparatus as claimed in claim 1, characterized in that for each unit formed by one of said upper and one of said lower support means, the turning mechanism comprises a link mechanism which transmits a rotary movement to a first rotating disc connected to said support means.

* * * * *